US007305196B2

(12) United States Patent
Kim et al.

(10) Patent No.: US 7,305,196 B2
(45) Date of Patent: Dec. 4, 2007

(54) APPARATUS FOR AND METHOD OF CONTROLLING HIGH VOLTAGE IN IMAGE FORMING APPARATUS

(75) Inventors: Min-seon Kim, Suwon-si (KR); Seung-deog An, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 248 days.

(21) Appl. No.: 11/014,902

(22) Filed: Dec. 20, 2004

(65) Prior Publication Data

US 2005/0248904 A1 Nov. 10, 2005

(30) Foreign Application Priority Data

Dec. 19, 2003 (KR) ..... 10-2003-0093692

(51) Int. Cl.
*G03G 15/09* (2006.01)

(52) U.S. Cl. ..... 399/55; 399/270

(58) Field of Classification Search ..... 399/55, 399/27 D

See application file for complete search history.

(56) References Cited

U.S. PATENT DOCUMENTS

| | | | | |
|---|---|---|---|---|
| 4,841,335 | A * | 6/1989 | Kohyama | 399/82 |
| 5,426,489 | A * | 6/1995 | Haneda et al. | 399/175 |
| 5,627,722 | A | 5/1997 | Hirst | 361/170 |
| 2004/0136741 | A1* | 7/2004 | Lee | 399/55 |
| 2004/0141766 | A1* | 7/2004 | Toyama | 399/50 |

FOREIGN PATENT DOCUMENTS

| | | |
|---|---|---|
| JP | 11-194579 | 7/1999 |
| JP | 2000-098700 | 4/2000 |
| JP | 2000-259017 | 9/2000 |
| JP | 2000-350362 | 12/2000 |
| JP | 2000-350464 | 12/2000 |
| JP | 2001-035986 | 2/2001 |
| JP | 2001-075366 | 3/2001 |
| JP | 2001-117325 | 4/2001 |
| JP | 2001-169546 | 6/2001 |
| JP | 2001-312123 | 11/2001 |
| JP | 2002-156882 | 5/2002 |
| KR | 1999-0126421 | 7/1998 |
| KR | 1998-080852 | 11/1998 |
| KR | 00183497 | 12/1998 |
| KR | 2000-0000579 | 1/2000 |

* cited by examiner

*Primary Examiner*—Walter Benson
(74) *Attorney, Agent, or Firm*—Staas & Halsey LLP

(57) ABSTRACT

An apparatus for and a method of controlling a high voltage in an image forming apparatus using the high voltage with a high alternating current voltage superimposed on a high direct current voltage. The apparatus includes: a high alternating current voltage output unit outputting the high alternating current voltage; a high direct current voltage output unit outputting the high direct current voltage; and a controlling unit controlling the high alternating current voltage output unit and the high direct current voltage output unit such that the high alternating current voltage is output before the high direct current voltage when the high voltage is required for printing.

21 Claims, 7 Drawing Sheets

APPARATUS FOR AND METHOD OF CONTROLLING HIGH VOLTAGE IN IMAGE FORMING APPARATUS

CROSS-REFERENCE TO RELATED APPLICATION

This application claims the priority of Korean Patent Application No. 2003-93692, filed on Dec. 19, 2003, in the Korean Intellectual Property Office, the disclosure of which is incorporated herein by reference.

BACKGROUND OF THE INVENTION

1. Field of the Invention

The present invention relates to an apparatus for and a method of controlling a high voltage in an electrophotographic image forming apparatus such as a laser printer, and more particularly, to an apparatus for and a method of controlling a high voltage by appropriately adjusting a sequence and a value of the high voltage, which includes an alternating current voltage superimposed on a direct current voltage, to be applied to a developer for printing a high quality image by preventing the forming of an image artifact such as a band.

2. Description of Related Art

Printers, copiers, facsimiles, or multi-function printers include an image forming apparatus to print an image. Generally, the image forming apparatus prints an image through charging, exposing, developing, transferring, and fusing processes.

FIG. 1 is a schematic view of a conventional image forming apparatus. Referring to FIG. 1, the image forming apparatus includes a charging roller 20, an organic photoconductive (OPC) drum 30, a transfer roller 40, a developer 50 including a developing roller 52 and a high voltage supply roller 56 for supplying a high voltage, a fuser 70, and a laser scanning unit (LSU) 80 to print image data on a sheet of paper.

The operation of the image forming apparatus will now be described. When a charging voltage is applied to the charging roller 20, the charged charging roller 20 rotates, thereby evenly charging an organic photoconductor formed on an outer circumferential surface of the OPC drum 30. Then, light emitted from the LSU 80 forms a latent electrostatic image on the surface of the charged OPC drum 30. A high voltage is then applied to the high voltage supply roller 56 and a lower voltage is applied to the developing roller 52. This difference in the levels of the applied voltages results in a difference between a potential of the supplying roller 56 and that of the developing roller 52, forcing toner with negative electric charge components to move from the roller for supplying a high voltage 56 to the developing roller 52. The toner supplied to the developing roller 52 is applied to the latent electrostatic image formed on the OPC drum 30, thereby forming a visible image. The high-voltage transfer roller 40 transfers the visible image onto a sheet of paper being moved. The visible image transferred onto the sheet of paper is fused on the sheet of paper with the high heat and pressure of the fuser 70. This is the end of the printing process.

In the printing process, the charging, developing, and transferring processes involve applying a high voltage of hundreds through thousands of volts to rollers. Image quality is determined by how much the high voltage applied to the rollers is controlled.

A conventional apparatus for controlling a high voltage applied to a developer is disclosed in U.S. Pat. No. 5,627,722. This apparatus uses a method of applying a high voltage with an alternating current (AC) voltage superimposed on a direct current (DC) voltage to a developer of an image forming apparatus. FIG. 2 is a block diagram of the conventional apparatus for controlling a high voltage of the '722 patent and FIG. 3 is a waveform diagram of a voltage output from the conventional apparatus for controlling the high voltage of the '722 patent.

Referring to FIG. 2, a controlling unit 100 included in the image forming apparatus controls a high AC voltage output unit 110 and a high DC voltage output unit 130 to control a high voltage with the AC voltage superimposed on the DC voltage, which is applied to a developer 150. To control the high voltage, the controlling unit 100 includes an AC peak-to-peak controller 102, an AC duty controller 104, an AC enable signal generator 106, and a DC pulse width modulation (PWM) controller 108. The controlling unit 100 may be a microprocessor using a control program. In this case, the AC peak-to-peak controller 102, the AC duty controller 104, the AC enable signal generator 106, and the DC PWM controller 108 may be terminals included in the microprocessor.

The AC peak-to-peak controller 102 generates an AC_Vp-p signal for controlling a peak-to-peak voltage of an AC voltage ACVpp. The AC voltage ACVpp is generally controlled using a PWM and ranges from 1 KV to 2.8 KV. The AC duty controller 104 generates an AC_Vduty signal for controlling a duty of the AC voltage ACVpp, that is, the on/off time of an AC voltage frequency, output from the high AC output unit 110. The AC duty controller 104 controls the duty of the high AC voltage ACVpp at 20-50% based on a negative voltage by using the PWM. The AC enable signal generator 106 generates an AC_Enable signal for enabling the high AC voltage output unit 110 to apply the high AC voltage ACVpp to the developer 150. If the AC_Enable signal is not generated, even though the AC_Vp-p signal and the AC_Vduty signal are generated, the AC voltage ACVpp is not applied to the developer 150.

The DC PWM controller 108 generates a DC_PWM signal for controlling the DC voltage DCV output from the high DC voltage output unit 130 using the PWM. The DC voltage DCV output from the high DC output unit 130 controlled by the DC PWM controller 108 ranges from 20V to 1000V and is applied to the developer 150.

The controlling unit 100 controls the high AC voltage output unit 110 and the high DC voltage output unit 130 such that they apply a high voltage with the AC voltage ACVpp superimposed on the DC voltage DCV to the developer 150. Here, the DC voltage DCV is first applied to the developer 150. Then, after a predetermined period of time, the controlling unit 100 sequentially transmits the AC_Vp-p signal, the AC_Vduty signal, and the AC_Enable signal to the high AC output unit 10, which then applies the AC voltage ACVpp to the developer 150.

This process will now be described in more detail with concurrent reference to FIGS. 1 and 3. As described with reference to FIG. 1, in a conventional printing sequence, a charging voltage is applied to the OPC drum 30. Then, a high voltage with the AC voltage ACVpp superimposed on the DC voltage DCV is applied to the developer 150. First, the DC voltage DCV is applied to the developer 150 at a duty (approximately 35% with 300V) required for printing. After the DC voltage DCV is applied to the developer 150, the AC voltage ACVpp is applied to the developer 150. Ultimately, the high voltage with the AC voltage ACVpp superimposed on the DC voltage DCV is applied to the developer 150. In response to the high voltage, the toner with negative electric charge components is moved to the developer 150 and applied to the latent electrostatic image formed on the surface of the OPC drum 30, thereby forming a visible image.

Values of the high voltage applied to the developer 150 are as follows. An initial duty of the AC_Vp-p signal generated by the controlling unit 100 to enable the high AC voltage output unit 110 to output the AC voltage ACVpp is approximately 17-25%, which is a set value required for printing. The AC voltage ACVpp output from the high AC voltage output unit 110 ranges from approximately 2000V to 2400V. When the AC_Vp-p signal is transmitted to the high AC voltage output unit 110, the AC_Vduty signal is also transmitted to the high AC voltage output unit 110. Here, a duty of the AC_Vduty signal is the same as a duty required for printing, that is, approximately 30-40%. Approximately 20 msec later after the AC_Vp-p signal and the AC_Vduty signal start to be transmitted to the high AC voltage output unit 110, the AC_Enable signal is turned on and transmitted to the high AC voltage output unit 110. When the AC_Enable signal is turned on, the AC voltage ACVpp is output from the high AC voltage output unit 110 and superimposed on the DC voltage DCV that is already being output from the high AC voltage output unit 110. Then, the superimposed AC voltage ACVpp and the DC voltage DCV are applied to the developer 150.

While the DC voltage DCV is being applied to the developer 150, if the AC voltage ACVpp is turned on AC ON, an undershoot and/or high voltage noise may be generated as illustrated in FIG. 3. As a result, an image artifact such as a band may be formed in a final image.

BRIEF SUMMARY

An aspect of the present invention provides an apparatus for and a method of controlling a high voltage in an image forming apparatus by appropriately adjusting a sequence and a value of the high voltage, which includes an alternating current (AC) voltage superimposed on a direct current (DC) voltage, to be applied to a developer for printing a high quality image by preventing the forming of an image artifact such as a band.

According to an aspect of the present invention, there is provided an apparatus for controlling a high voltage in an image forming apparatus using the high voltage with a high alternating current voltage superimposed on a high direct current voltage. The apparatus for controlling the high voltage includes: a high AC voltage output unit outputting the high AC voltage; a high DC voltage output unit outputting the high DC voltage; and a controlling unit controlling the high AC voltage output unit and the high DC voltage output unit such that the high AC voltage can be output before the high DC voltage when the high voltage is required for printing.

The controlling unit may include: a peak-to-peak controller generating an AC_Vp-p signal for controlling a peak-to-peak voltage of the high AC voltage AC_Vpp output from the high AC voltage output unit; a duty controller generating an AC_Vduty signal for controlling a duty of the high AC voltage; an enable signal generator generating an AC_Enable signal for outputting the high AC voltage; a DC pulse width modulation (PWM) controller generating a DC_PWM signal for controlling the high DC voltage output from the high DC voltage output unit by using a PWM; and a signal processor controlling an operating sequence of each of the peak-to-peak controller, the duty controller, the enable signal generator, and the direct current pulse width modulation controller as well as the AC_Vp-p signal, AC_Vduty signal, the AC_Enable signal, and the DC_PWM signal respectively generated by each of the same.

According to another aspect of the present invention, there is provided a method of controlling a high voltage in an image forming apparatus including a high AC voltage output unit outputting a high AC voltage and a high DC voltage output unit outputting a high DC voltage. The method includes: outputting the high AC voltage when the high voltage is required for printing; and outputting the high DC voltage after the high AC voltage is generated such that the high AC voltage is superimposed on the high DC voltage.

The outputting of the high AC voltage may include: outputting the high AC voltage for a first time at a level lower than a level required for printing; and outputting the high AC voltage for a second time at the level required for printing after a predetermined period of time after the high AC voltage is generated for the first time.

The method may further include: generating an AC_Vp-p signal for controlling a peak-to-peak voltage of the high AC voltage output from the high AC voltage output unit; generating an AC_Vduty signal for controlling a duty of the high AC voltage; generating an AC_Enable signal for outputting the high AC voltage; generating a DC_PWM signal for controlling the high DC voltage output from the high DC voltage output unit by using a PWM; and controlling the high AC voltage output unit and the high DC voltage output unit such that the AC_Vp-p signal and the AC_Vduty signal can be generated before the DC_PWM signal.

According to another aspect of the present invention, there is provided a method of minimizing a voltage undershoot in an image forming apparatus, including: determining whether printing has started; generating for a first time, when the printing is determined to have started, an AC_Vp-p signal for controlling the peak-to-peak voltage of the high AC voltage ACVpp and a AC_Vduty signal for controlling the duty of the AC peak-to-peak voltage ACVpp; checking whether a first predetermined period of time has passed; generating, when the first predetermined period of time is determined to have passed, an AC_Enable signal; determining, after the generating an AC_Enable signal, whether a second predetermined period of time has passed; generating for a second time, when the second predetermined period of time is determined to have passed, the AC_Vp-p signal and the AC_Vduty signal; determining, after the generating for a second time, whether a third predetermined period of time has passed; generating, when the third predetermined period of time is determined to have passed, a DC_PWM signal; and superimposing, when the DC_PWM signal is generated, a high AC voltage ACVpp on a DC voltage DCV to yield a superimposed high voltage; and applying the superimposed high voltage to a developer.

Additional and/or other aspects and advantages of the present invention will be set forth in part in the description which follows and, in part, will be obvious from the description, or may be learned by practice of the invention

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENT

Figure 1:
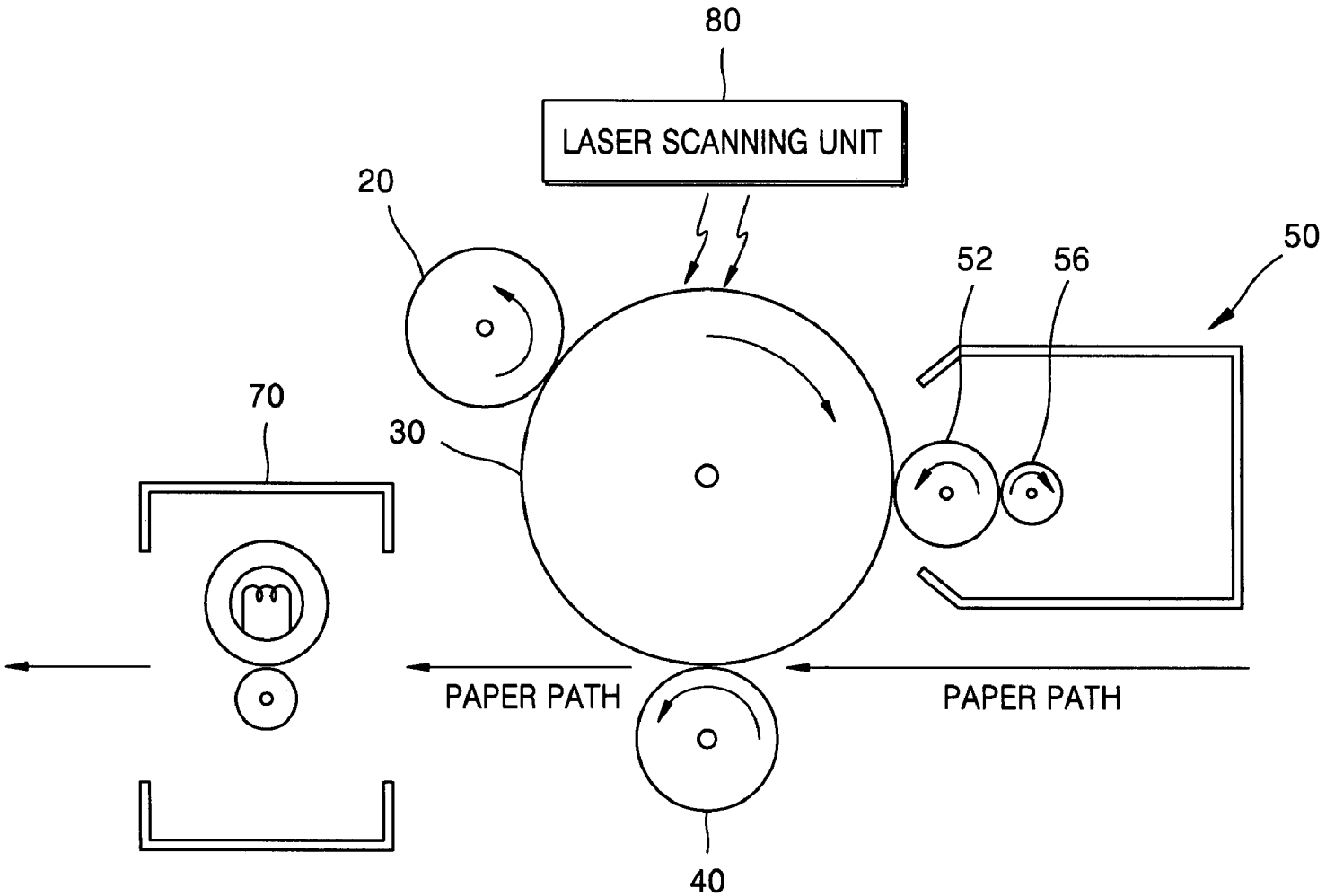
FIG. 1 (PRIOR ART)
FIG. 1 is a schematic view of a conventional image forming apparatus.
Figure 2:
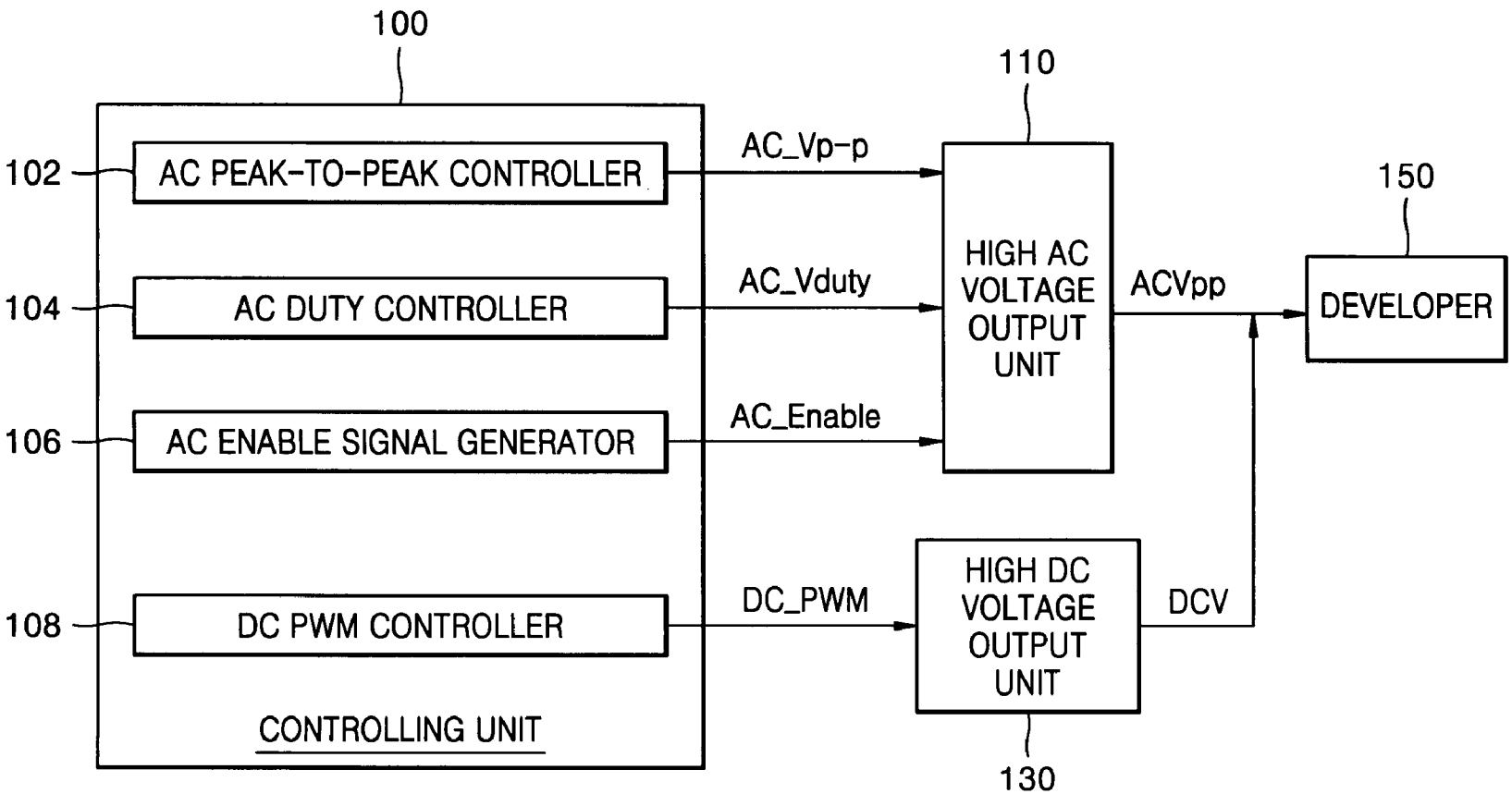
FIG. 2 (PRIOR ART)
FIG. 2 is a block diagram of a conventional apparatus for controlling a high voltage in an image forming apparatus.
Figure 3:
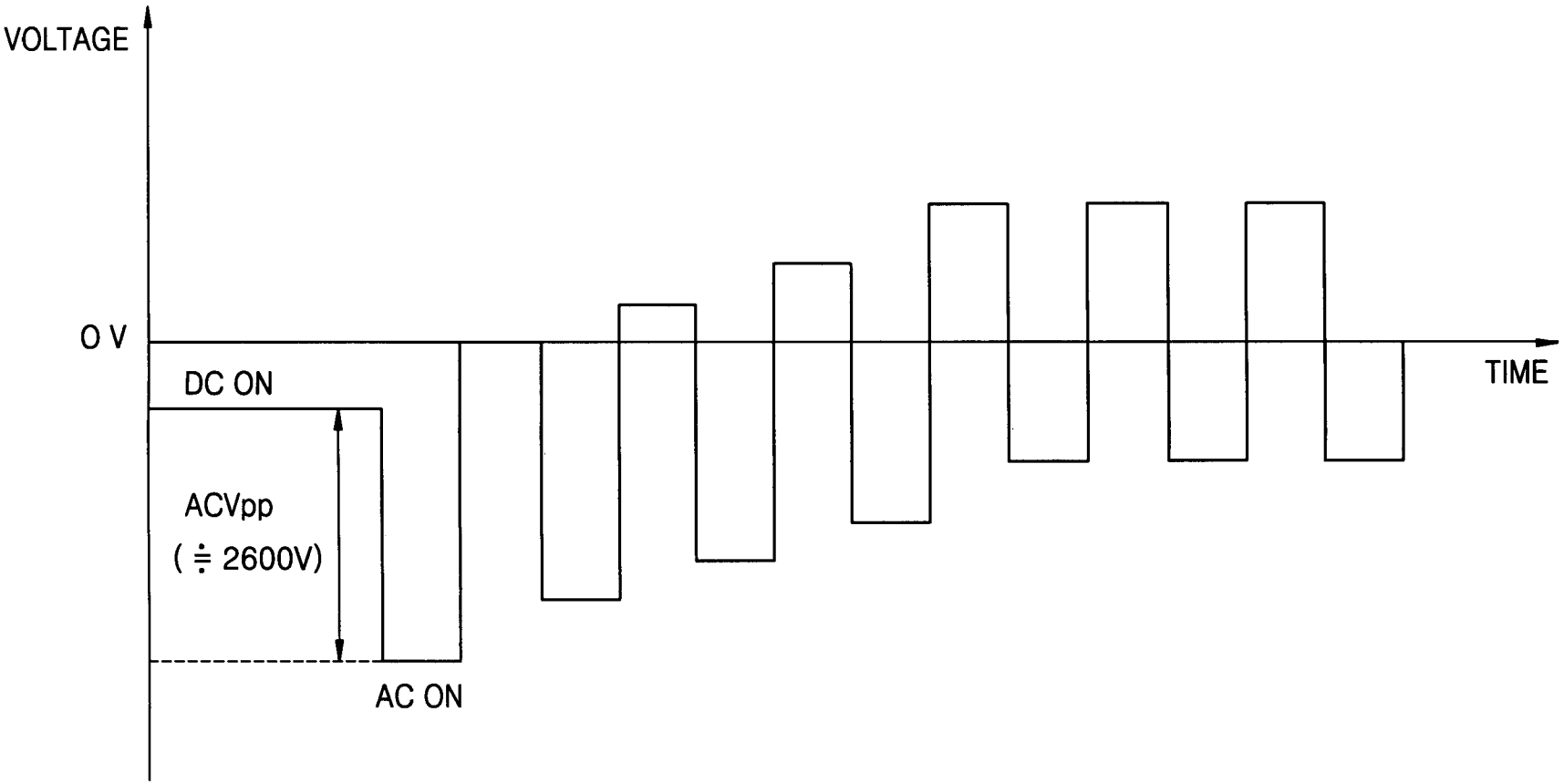
FIG. 3 (PRIOR ART)
FIG. 3 is a waveform diagram of a voltage output from the conventional apparatus for controlling the high voltage of FIG. 2.

Reference will now be made in detail to an embodiment of the present invention, examples of which are illustrated in the accompanying drawings, wherein like reference numerals refer to the like elements throughout. The embodiment is described below in order to explain the present invention by referring to the figures.

Figure 4:
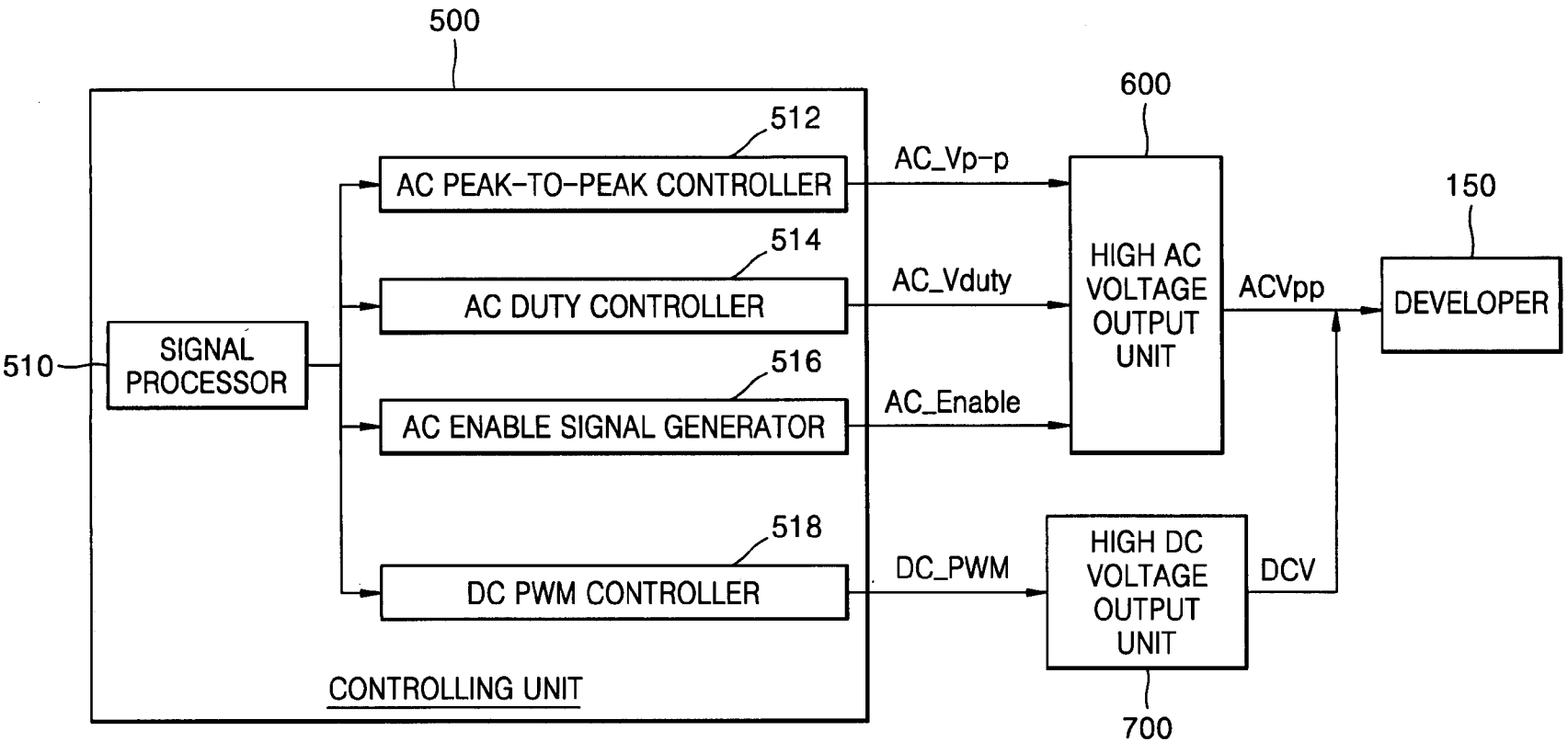
FIG. 4 is a block diagram of an apparatus for controlling a high voltage in an image forming apparatus according to an embodiment of the present invention.
Figure 5:
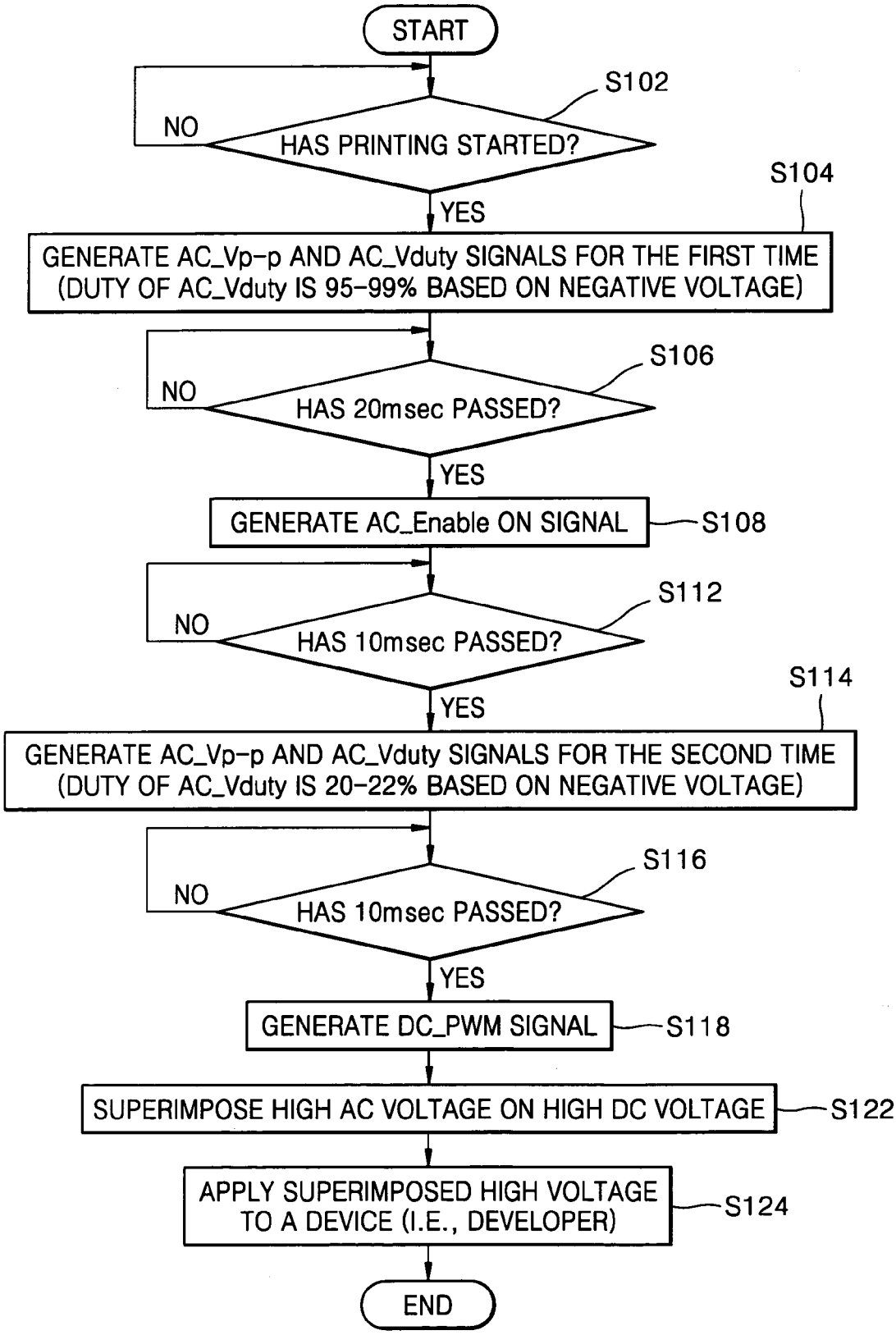
FIG. 5 is a flowchart illustrating a method of controlling a high voltage in an image forming apparatus according to the embodiment of FIG. 4.
Figure 6:
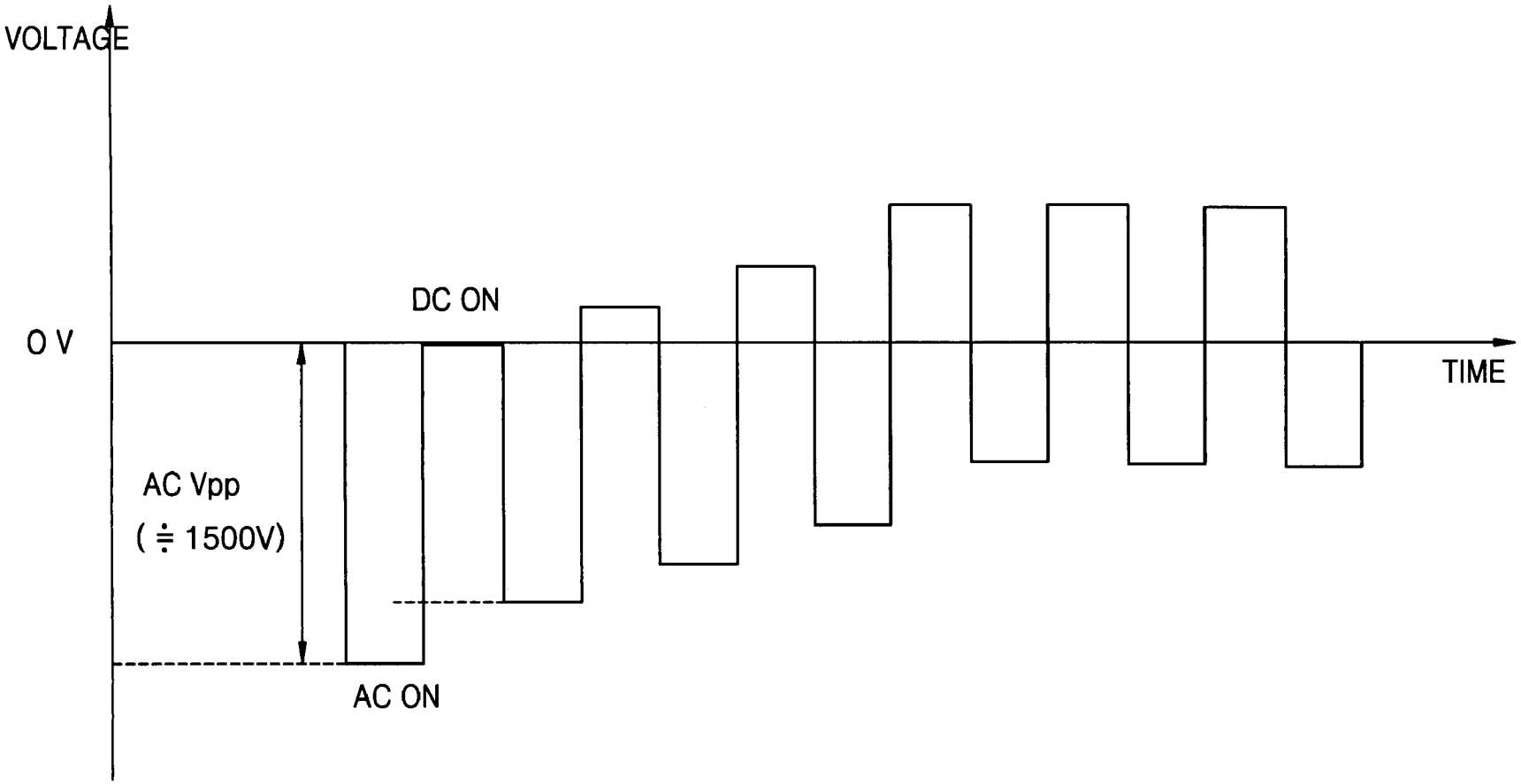
FIG. 6 is a waveform diagram of a high voltage with a high alternating current voltage superimposed on a high direct current voltage according to the embodiment of FIG. 4.
Figure 7:
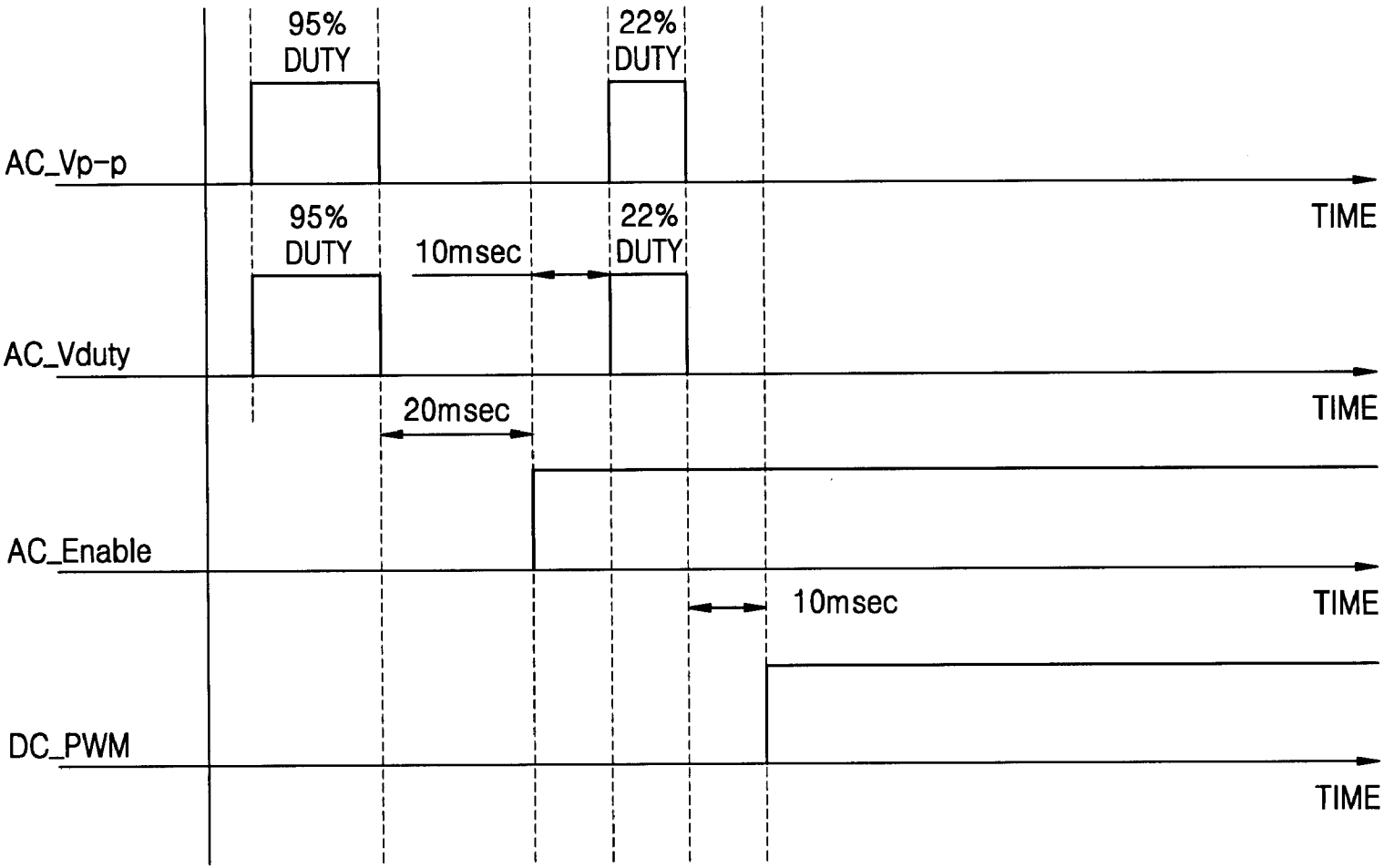
FIG. 7 is a timing diagram of an output signal according to the embodiment of FIG. 4.

FIG. 4 is a block diagram of an apparatus for controlling a high voltage in an image forming apparatus, according to an embodiment of the present invention. FIG. 5 is a flowchart illustrating a method of controlling a high voltage in an image forming apparatus, according to the present embodiment. FIG. 6 is a waveform diagram of a high voltage with a high alternating current (AC) voltage superimposed on a high direct current (DC) voltage according to the present embodiment. FIG. 7 is a timing diagram of an output signal according to the present embodiment.

The image forming apparatus utilizes a high voltage with the high AC voltage ACVpp superimposed on the high DV voltage DCV.

Referring to FIG. 4, the apparatus for controlling a high voltage includes a high AC voltage output unit 600 outputting the high AC voltage ACVpp, a high DC voltage output unit 700 outputting the high DC voltage DCV, and a controlling unit 500. When a developer 150 requires a high voltage for printing, the controlling unit 500 controls the high AC voltage output unit 600 and the high DC voltage output unit 700 such that the high AC voltage ACVpp can be output before the high DC voltage DCV.

The controlling unit 500 includes an AC peak-to-peak controller 512, an AC duty controller 514, an AC enable signal generator 516, a DC PWM controller 518, and a signal processor 510. The AC peak-to-peak controller 512 generates an AC_Vp-p signal for controlling a peak-to-peak voltage of the high AC voltage ACVpp output from the high AC voltage output unit 600. The AC duty controller 514 generates an AC_Vduty signal for controlling a duty of the high AC voltage ACVpp. The AC enable signal generator 516 generates an AC_Enable signal for enabling the high AC voltage output unit 600 to output the high AC voltage ACVpp. The DC pulse width modulation (PWM) controller 518 generates a DC_PWM signal for controlling the high DC voltage DCV output from the high DC voltage output unit 700 by using a PWM. A signal processor 510 controls the operating sequence of the AC peak-to-peak controller 512, the AC duty controller 514, the AC enable signal generator 516, the DC PWM controller 518, and signals output from the same. The signal processor 510 controls the AC peak-to-peak controller 512 and the AC duty controller 514 such that the DC_PWM signal can be generated before the AC_Vp-p signal and the AC_Vduty signal.

The controlling unit 500 may be a microprocessor using a control program. In this case, the AC peak-peak controller 512, the AC duty controller 514, and the DC PWM controller 518 may be terminals included in the microprocessor. The signal processor 510 may use the control program of the microprocessor.

The controlling unit 500 controls the AC duty controller 514 to generate the AC_Vduty signal at a duty of 95-99% such that a duty of the high AC voltage ACVpp output from the high AC voltage output unit 600 can be 95-99% based on a negative voltage. After a predetermined period of time (for example, 20 msec) after the AC_Vp-p signal and the AC_Vduty are output for a first time, the AC enable signal generator 516 included in the controlling unit 500 generates the AC_Enable signal that is turned on. After a predetermined period of time (for example, 10 msec), the AC peak-to-peak controller 512 and the AC duty controller 514 output the AC_Vp-p signal and the AC_Vduty signal, respectively, for a second time at a predetermined duty (for example, 20-22% based on a negative voltage). After a predetermined period of time (for example, 10 msec), the DC PWM controller 518 generates the DC_PWM signal.

When a first duty of the AC_Vduty signal is 95%, the AC voltage ACVpp is approximately 1500V. When a second duty of the AC_Vduty signal is 22%, the AC voltage ACVpp is approximately 2200V. The reason why the initial AC voltage ACVpp is made low by having the high first duty of the AC_Vduty signal based on the negative standard is to aggressively reduce the undershoot that may occur when outputting the turned on AC voltage ACVpp. The AC voltage ACVpp (2200V) is a normal voltage level required for printing when the second duty is 22%. Consequently, when the AC voltage ACVpp is turned on, the apparatus for controlling a high voltage according to the present embodiment has less undershoot than conventional apparatuses for controlling a high voltage and, thus, provides improved image quality over the conventional art.

A method of controlling a high voltage embodied by the apparatus for controlling a high voltage in the image forming apparatus according to the present invention will now be described with reference to FIGS. 5 through 7.

The controlling unit 500 checks whether printing has started (S102). When the printing has started, the controlling unit 500 controls the signal processor 510 such that the AC peak-to-peak controller 512 and the AC duty controller 514 initially generate the AC_Vp-p signal for controlling the peak-to-peak voltage of the high AC voltage ACVpp and the AC_Vduty signal for controlling the duty of the AC peak-to-peak voltage ACVpp, respectively (S104). A duty of the AC_Vduty signal may be 95-99% and the high AC voltage ACVpp corresponding to the duty is approximately 1500V. The high AC voltage ACVpp corresponding to the duty is low to prevent the undershoot that occurs when the high AC voltage ACVpp is on as illustrated in FIG. 6.

After the AC_Vp-p signal and the AC_Vduty signal are generated for a first time, the controlling unit 500 checks whether a predetermined period of time (for example, 20 msec) has passed (S106). When the predetermined period of time has passed, the AC enable signal generator 516 generates the AC_Enable signal that is turned on (S108). When the AC_Enable signal is turned on, the high AC voltage ACVpp is output from the high AC voltage output unit 600 and applied to the developer 150.

After the turned-on AC_Enable signal is output, the controlling unit 500 checks whether a predetermined period of time (for example, 10 msec) has passed (S112). When the predetermined period of time has passed, the AC peak-to-peak controller 512 and the AC duty controller 514, respectively, generate the AC_Vp-p signal and the AC_Vduty signal for a second time (S114). The controlling unit 500 may maintain a duty of the AC_Vduty signal at 20-22% based on the negative standard. The high AC voltage ACVpp corresponding to the duty may be 2200V, which is a normal voltage level required for printing (S114).

After the AC_Vp-p signal and the AC_Vduty signal are generated for the second time, the controlling unit 500 checks whether a predetermined period of time (for example, 10 msec) has passed (S116). When the predetermined period of time has passed, the DC PWM controller 518 generates the DC_PWM signal (S118). When the DC_PWM signal is generated by the DC PWM controller 518, a high voltage with the high AC voltage ACVpp superimposed on the DC voltage DCV is applied to the developer 150 (S122 and S124).

The disclosed embodiment of the present invention reduces the undershoot by using a low voltage when applying a high AC voltage. In addition, since a high DC voltage is applied after applying the high AC voltage, a high voltage can be secured in a stable manner. Therefore, the present embodiment may prevent the forming of an abnormal image with noise, which is caused by applying the high voltage.

The described embodiment of the present invention has been described using a case where a high voltage with an AC voltage superimposed on a DC voltage is applied to a developer. However, it is to be understood that the high voltage may also be applied to other devices apart from the developer.

Although an embodiment of the present invention has been shown and described, the present invention is not limited to the described embodiment. Instead, it would be appreciated by those skilled in the art that changes may be made to the embodiment without departing from the principles and spirit of the invention, the scope of which is defined by the claims and their equivalents.

What is claimed is:

1. An apparatus for controlling a high voltage in an image forming apparatus using the high voltage with a high alternating current voltage superimposed on a high direct current voltage, comprising:

a high alternating current voltage output unit outputting the high alternating current voltage;

a high direct current voltage output unit outputting the high direct current voltage; and a controlling unit controlling the high alternating current voltage output unit and the high direct current voltage output unit such that the high alternating current voltage is output before the high direct current voltage when the high voltage is required for printing, wherein the controlling unit includes:

a peak-to-peak controller generating an AC_Vp-p signal for controlling a peak-to-peak voltage ACVpp of the high alternating current voltage output from the high alternating current voltage output unit;

a duty controller generating an AC_Vduty signal for controlling a duty of the high alternating current voltage;

an enable signal generator generating an AC_Enable signal for outputting the high alternating current voltage;

a direct current pulse width modulation controller generating a DC_PWM signal for controlling the high direct current voltage output from the high direct current voltage output unit by using a pulse width modulation; and a signal processor controlling an operating sequence of each of the peak-to-peak controller, the duty controller, the enable signal generator, and the direct current pulse width modulation controller as well as the AC_Vp-p signal, AC_Vduty signal, the AC_Enable signal, and the DC_PWM signal respectively generated by each of the same, wherein the signal processor controls the peak-to-peak controller and the duty controller such that the AC_Vp-p signal and the AC_Vduty signal can be generated before the DC_PWM signal.

2. The apparatus of claim 1, wherein a duty of the AC_Vduty signal is maintained at between 95 and 99 percent based on a negative voltage such that a duty of the high alternating current voltage is between 95 and 99 percent based on the negative voltage.

3. The apparatus of claim 1, wherein the AC_Enable signal that is turned on is generated after a predetermined period of time after the AC_Vp-p signal and the AC_Vduty signal are generated for a first time.

4. The apparatus of claim 3, wherein the predetermined period of time is 20 msec.

5. The apparatus of claim 3, wherein the AC_Vp-p signal and the AC_Vduty signal are generated at a predetermined duty for a second time after a predetermined period of time after the turned on AC_Enable signal is generated.

6. The apparatus of claim 5, wherein the predetermined period of time is 10 msec, and the predetermined duty is 20 through 22 percent at the negative standard.

7. The apparatus of claim 5, wherein the DC_PWM signal is generated after a predetermined period of time after the AC_Vp-p signal and the AC_Vduty signal are generated for the second time.

8. The apparatus of claim 7, wherein the predetermined period of time is 10 msec.

9. A method of controlling a high voltage in an image forming apparatus comprising a high alternating current voltage output unit outputting a high alternating current voltage and a high direct current voltage output unit outputting a high direct current voltage, comprising:

outputting the high alternating current voltage when the high voltage is required for printing;

outputting the high direct current voltage after the high alternating current voltage is generated such that the high alternating current voltage is superimposed on the high direct current voltage;

generating an AC_Vp-p signal for controlling a peak-to-peak voltage of the high alternating current voltage output from the high alternating current voltage output unit;

generating an AC_Vduty signal for controlling a duty of the high alternating current voltage;

generating an AC_Enable signal for outputting the high alternating current voltage;

generating a DC_PWM signal for controlling the high direct current voltage output from the high direct current voltage output unit by using a pulse width modulation; and controlling the high AC voltage output unit and the DC voltage output unit such that the AC_Vp-p signal and the AC_Vduty signal can be generated before the DC_PWM signal.

10. The method of claim 9, wherein the outputting of the high alternating current voltage includes:

outputting the high alternating current voltage for a first time at a level lower than a level required for printing; and outputting the high alternating current voltage for a second time at the level required for printing after a predetermined period of time after the high alternating current voltage is generated for the first time.

11. The method of claim 9, wherein a duty of the AC_Vduty signal is maintained at between 95 and 99 percent based on a negative voltage such that a duty of the high alternating current voltage is between 95 and 99 percent based on the negative voltage.

12. The method of claim 9, wherein the AC_Enable signal that is turned on is generated after a predetermined period of time after the AC_Vp-p signal and the AC_Vduty signal are generated for a first time.

13. The method of claim 12, wherein the predetermined period of time is 20 msec.

14. The method of claim 12, wherein the AC_Vp-p signal and the AC_Vduty signal are generated at a predetermined duty for a second time after a predetermined period of time after the turned on AC_Enable signal is generated.

15. The method of claim 14, wherein the predetermined period of time is 10 msec, and the predetermined duty is between 20 and 22 percent at the negative standard.

16. The method of claim 14, wherein the DC_PWM signal is generated after a predetermined period of time after the AC_Vp-p signal and the AC_Vduty signal are generated for the second time.

17. The method of claim 16, wherein the predetermined period of time is 10 msec.

18. The method of claim 9, wherein, when a first duty of the AC_Vduty signal is 95%, the AC voltage ACVpp is approximately 1500V.

19. The method of claim 9, wherein, when a second duty of the AC_Vduty signal is 22%, the AC voltage ACVpp is approximately 2200V.

20. A method of minimizing a voltage undershoot in an image forming apparatus, comprising:

determining whether printing has started;

generating for a first time, when the printing is determined to have started, an AC_Vp-p signal for controlling the peak-to-peak voltage of the high AC voltage ACVpp and a AC_Vduty signal for controlling the duty of the AC peak-to-peak voltage ACVpp;

checking whether a first predetermined period of time has passed;

generating, when the first predetermined period of time is determined to have passed, an AC_Enable signal;

determining, after the generating an AC_Enable signal, whether a second predetermined period of time has passed;

generating for a second time, when the second predetermined period of time is determined to have passed the AC_Vp-p signal and the AC_Vduty signal;

determining, after the generating for a second time, whether a third predetermined period of time has passed;

generating, when the third predetermined period of time is determined to have passed, a DC_PWM signal;

superimposing, when the DC_PWM signal is generated, a high AC voltage ACVpp on a DC voltage DCV to yield a superimposed high voltage; and applying the superimposed high voltage to a developer.

21. The method of claim 20, wherein a the high AC voltage ACVpp corresponding to the duty is low to prevent a voltage.

* * * * *

UNITED STATES PATENT AND TRADEMARK OFFICE

CERTIFICATE OF CORRECTION

PATENT NO. : 7,305,196 B2
APPLICATION NO. : 11/014902
DATED : December 4, 2007
INVENTOR(S) : Min-seon Kim et al.

It is certified that error appears in the above-identified patent and that said Letters Patent is hereby corrected as shown below:

Column 10, Line 20, after “passed” insert --,--.

Column 10, Line 31, after “wherein” delete “a”.

Signed and Sealed this

Seventeenth Day of June, 2008

JON W. DUDAS
*Director of the United States Patent and Trademark Office*